US008590330B2

(12) United States Patent
Walker et al.

(10) Patent No.: US 8,590,330 B2
(45) Date of Patent: Nov. 26, 2013

(54) ELECTRIC TRANSPORT REFRIGERATION UNIT WITH TEMPERATURE-BASED DIESEL OPERATION

(75) Inventors: Timothy A. Walker, Plymouth, MN (US); Luis Camacho, Farmington, MN (US)

(73) Assignee: Thermo King Corporation, Minneapolis, MN (US)

( * ) Notice: Subject to any disclaimer, the term of this patent is extended or adjusted under 35 U.S.C. 154(b) by 821 days.

(21) Appl. No.: 12/792,821

(22) Filed: Jun. 3, 2010

(65) Prior Publication Data

US 2011/0301762 A1 Dec. 8, 2011

(51) Int. Cl.
*F25B 27/00* (2006.01)

(52) U.S. Cl.
USPC ..... 62/236; 62/243

(58) Field of Classification Search
USPC ..... 62/228.1, 230, 236, 239, 243
See application file for complete search history.

(56) References Cited

U.S. PATENT DOCUMENTS

| | | | |
|---|---|---|---|
| 2,058,872 | A | 10/1936 | Heideman |
| 3,100,384 | A | 8/1963 | Lowensohn |
| 3,512,373 | A | 5/1970 | White |
| 3,545,222 | A | 12/1970 | Petranek |
| 3,720,842 | A | 3/1973 | Martin et al. |
| 3,866,433 | A | 2/1975 | Krug |
| 3,875,483 | A | 4/1975 | Farr |
| 3,974,660 | A | 8/1976 | Farr |
| 4,780,618 | A | 10/1988 | Wareman et al. |
| 4,934,158 | A | 6/1990 | Sakano |
| 4,977,752 | A | 12/1990 | Hanson |
| 5,012,653 | A | 5/1991 | Ryde et al. |
| 5,105,096 | A | 4/1992 | Waldschmidt et al. |
| 5,125,236 | A | 6/1992 | Clancey et al. |
| 5,172,560 | A | 12/1992 | Jurewicz et al. |

(Continued)

FOREIGN PATENT DOCUMENTS

| | | |
|---|---|---|
| EP | 1046525 | 10/2000 |
| EP | 1279907 | 1/2003 |

(Continued)

OTHER PUBLICATIONS

Thermo King, SB-210+, available online at: <http://www.thermoking.com/products/product/sb210.asp?inc=no&pg=print>, available at least as early as Feb. 24, 2010.

(Continued)

*Primary Examiner* — Marc Norman
(74) *Attorney, Agent, or Firm* — Michael Best & Friedrich LLP

(57) ABSTRACT

A method of operating a transport refrigeration unit that is operable to regulate a temperature of a cargo space. The method includes providing a controller, driving a refrigerant compressor of the transport refrigeration unit with an internal combustion engine to compress a refrigerant defining an engine operating state of the transport refrigeration unit, and driving the refrigerant compressor of the transport refrigeration unit with an electric motor to compress the refrigerant defining a motor operating state of the transport refrigeration unit. The method further includes sensing the temperature of the cargo space, receiving into the controller a signal indicative of the temperature of the cargo space, determining the temperature of the cargo space using the controller, and switching between the engine operating state and the motor operating state in response to a signal generated by the controller based on the temperature of the cargo space.

17 Claims, 3 Drawing Sheets

(56) References Cited

U.S. PATENT DOCUMENTS

| | | | | |
|---|---|---|---|---|
| 5,177,978 | A | 1/1993 | Brown | |
| 5,186,015 | A | 2/1993 | Roehrich et al. | |
| 5,295,364 | A | 3/1994 | Truckenbrod et al. | |
| 5,487,278 | A | 1/1996 | Hilleveld et al. | |
| 5,867,996 | A | 2/1999 | Takano et al. | |
| 5,916,253 | A | 6/1999 | Amr et al. | |
| 6,223,546 | B1 | 5/2001 | Chopko et al. | |
| 6,321,550 | B1 | 11/2001 | Chopko et al. | |
| 6,351,957 | B2 | 3/2002 | Hara | |
| 6,405,550 | B1 | 6/2002 | Reason et al. | |
| 6,543,242 | B2 | 4/2003 | Reason et al. | |
| 6,543,243 | B2 | 4/2003 | Mohrmann et al. | |
| 6,688,125 | B2 | 2/2004 | Okamoto et al. | |
| 6,748,750 | B2 | 6/2004 | Choi | |
| 6,755,041 | B2 | 6/2004 | Wessells et al. | |
| 6,813,897 | B1 | 11/2004 | Bash et al. | |
| 6,813,898 | B2 | 11/2004 | Lindsay et al. | |
| 6,862,499 | B1 | 3/2005 | Cretella et al. | |
| 6,892,549 | B2 * | 5/2005 | Komura et al. | 62/228.5 |
| 6,910,341 | B2 | 6/2005 | Srichai et al. | |
| 6,973,798 | B2 | 12/2005 | Ikura et al. | |
| 6,978,632 | B2 | 12/2005 | Suzuki et al. | |
| 7,043,932 | B2 | 5/2006 | Tofflemire | |
| 2002/0108388 | A1 | 8/2002 | Wilson et al. | |
| 2007/0052241 | A1 | 3/2007 | Pacy | |
| 2007/0289325 | A1 | 12/2007 | Stone | |
| 2008/0034773 | A1 | 2/2008 | Karapetian | |
| 2008/0087029 | A1 | 4/2008 | Renken et al. | |
| 2008/0271472 | A1 | 11/2008 | Leroy | |
| 2009/0056354 | A1 | 3/2009 | Davis et al. | |

FOREIGN PATENT DOCUMENTS

| | | |
|---|---|---|
| EP | 1712383 | 10/2006 |
| EP | 1790921 | 5/2007 |
| EP | 1912327 | 4/2008 |
| GB | 2164433 | 3/1986 |
| GB | 2293703 | 4/1996 |
| JP | 11091433 | 4/1999 |
| JP | 2000127753 | 5/2000 |
| JP | 2001074337 | 3/2001 |
| JP | 20002081821 | 3/2002 |
| JP | 2003341414 | 12/2003 |
| JP | 2007112357 | 5/2007 |
| JP | 2008281289 | 11/2008 |
| WO | 2007/046329 | 4/2007 |
| WO | 2007/046330 | 4/2007 |
| WO | 2007/084131 | 7/2007 |
| WO | 2008/000071 | 1/2008 |
| WO | 2008/090949 | 7/2008 |
| WO | 2008/153518 | 12/2008 |

OTHER PUBLICATIONS

Thermo King, SR-2, Easy Read Controller,available online at: <http://www.thermoking.com/products/product/sr2.asp?inc=no &pg=print>, available at least as early as Feb. 24, 2010.

* cited by examiner

ELECTRIC TRANSPORT REFRIGERATION UNIT WITH TEMPERATURE-BASED DIESEL OPERATION

BACKGROUND

The present invention relates to a transport refrigeration unit and a method of operating a transport refrigeration unit.

Trucks and tractor-trailer combinations frequently transport cargo that must be maintained at a predetermined temperature (i.e., a set point temperature) or within a predetermined temperature range during transportation. Vehicles that transport temperature sensitive cargo typically have one or more cargo spaces that are maintained within the temperature range by a transport refrigeration unit having an electronic controller, a compressor, a condenser, a flow control valve, an expansion valve, and an evaporator coil. Operation of the transport refrigeration unit is generally controlled and monitored by the electronic controller.

Typically, transport refrigeration units operate in cooling and heating modes, depending, at least in part, upon the temperature of the cargo space and the ambient temperature outside the air-conditioned cargo space. When the temperature of the cargo space is above the set point temperature, the transport refrigeration unit operates in the cooling mode to pull down the temperature in the cargo space. During operation in the cooling mode, refrigerant is directed along a refrigerant circuit, which extends between the compressor, the flow control valve, the condenser, the expansion valve, and the evaporator coil. The cargo space air is then exposed to the relatively cool evaporator coil.

When the temperature of the cargo space is below the set point temperature, the transport refrigeration unit operates in the heating mode. During operation in the heating mode, relatively warm refrigerant is directed through a heating circuit, which extends from the compressor, the flow control valve, and the evaporator coil. The cargo space air is then exposed to the relatively warm evaporator coil.

SUMMARY

In one embodiment, the invention provides a method of operating a transport refrigeration unit that is operable to regulate a temperature of a cargo space. The method includes providing a controller, driving a refrigerant compressor of the transport refrigeration unit with an internal combustion engine to compress a refrigerant defining an engine operating state of the transport refrigeration unit, and driving the refrigerant compressor of the transport refrigeration unit with an electric motor to compress the refrigerant defining a motor operating state of the transport refrigeration unit. The method further includes sensing the temperature of the cargo space, receiving into the controller a signal indicative of the temperature of the cargo space, determining the temperature of the cargo space using the controller, and switching between the engine operating state and the motor operating state in response to a signal generated by the controller based on the temperature of the cargo space.

In another embodiment the invention provides a transport refrigeration unit that is operable to regulate a temperature of a cargo space. The transport refrigeration unit includes a sensor configured to sense the temperature of the cargo space and a controller configured to receive a signal from the sensor indicative of the temperature and configured to determine the temperature. The transport refrigeration unit further includes a refrigerant compressor operable to compress a refrigerant, an internal combustion engine configured to drive the refrigerant compressor to compress the refrigerant defining an engine operating state of the transport refrigeration unit, and an electric motor configured to drive the refrigerant compressor to compress the refrigerant defining a motor operating state of the transport refrigeration unit. A coupling is configured to selectively couple at least one of the internal combustion engine and the electric motor to the refrigerant compressor to drive the refrigerant compressor, and the controller is configured to switch between the engine operating state and the motor operating state in response to a signal generated by the controller based on the temperature of the cargo space.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
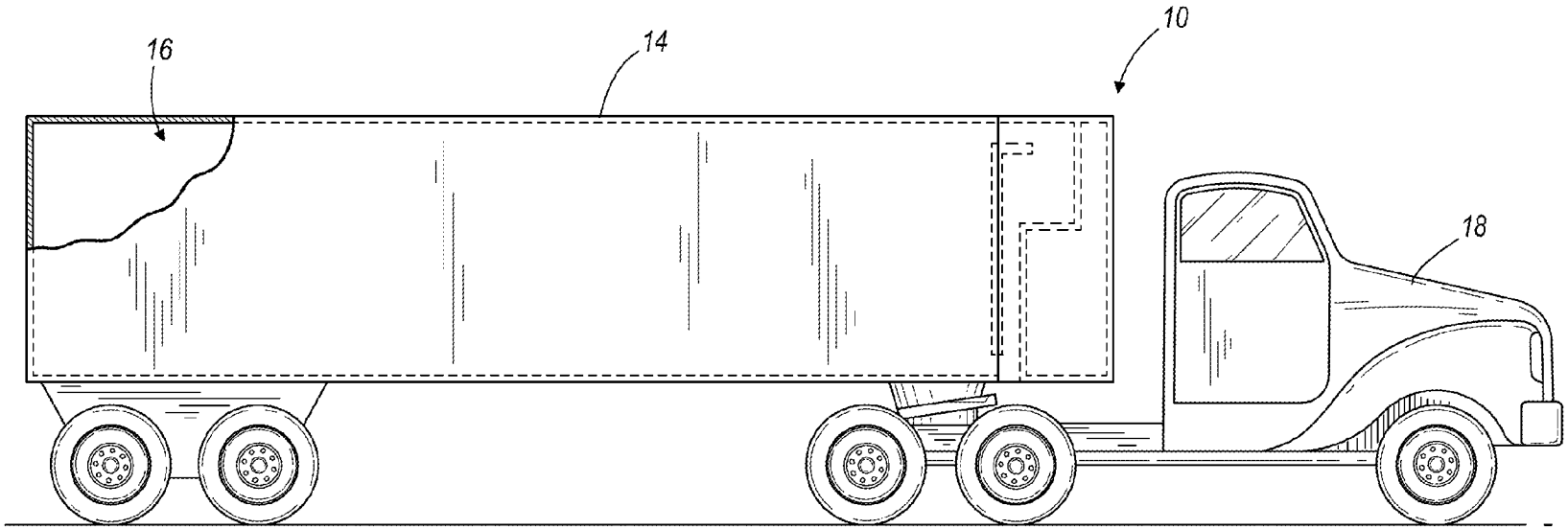
FIG. 1 is a side view, partially in section, of a vehicle having a transport refrigeration unit according to one embodiment of the invention.

FIG. 1 illustrates a transport refrigeration unit ("TRU") 10. The TRU 10 is especially suitable for use in transport applications and can be mounted on a container, truck, trailer, and the like. FIG. 1 shows the TRU 10 mounted on a trailer 14 having a cargo space 16. The trailer 14 is pulled by a tractor 18. In other constructions (not shown), the TRU 10 can be mounted on a storage container or another vehicle, such as, for example, a truck. Furthermore, although the unit 10 is referred to as a refrigeration unit, as will be discussed in more detail below, the TRU 10 is not limited to use in cooling modes and the TRU can also be used in heating modes.

As used herein and in the claims, the term "refrigerant" includes any conventional refrigeration fluid, such as, for example, chlorofluorocarbons (CFCs), hydrocarbons, cryogens (e.g., $CO_2$, and $N_2$), etc. In addition, as used herein and in the claims, the term "refrigerant" refers to fluids also commonly used for heating and defrosting purposes.

Figure 2:
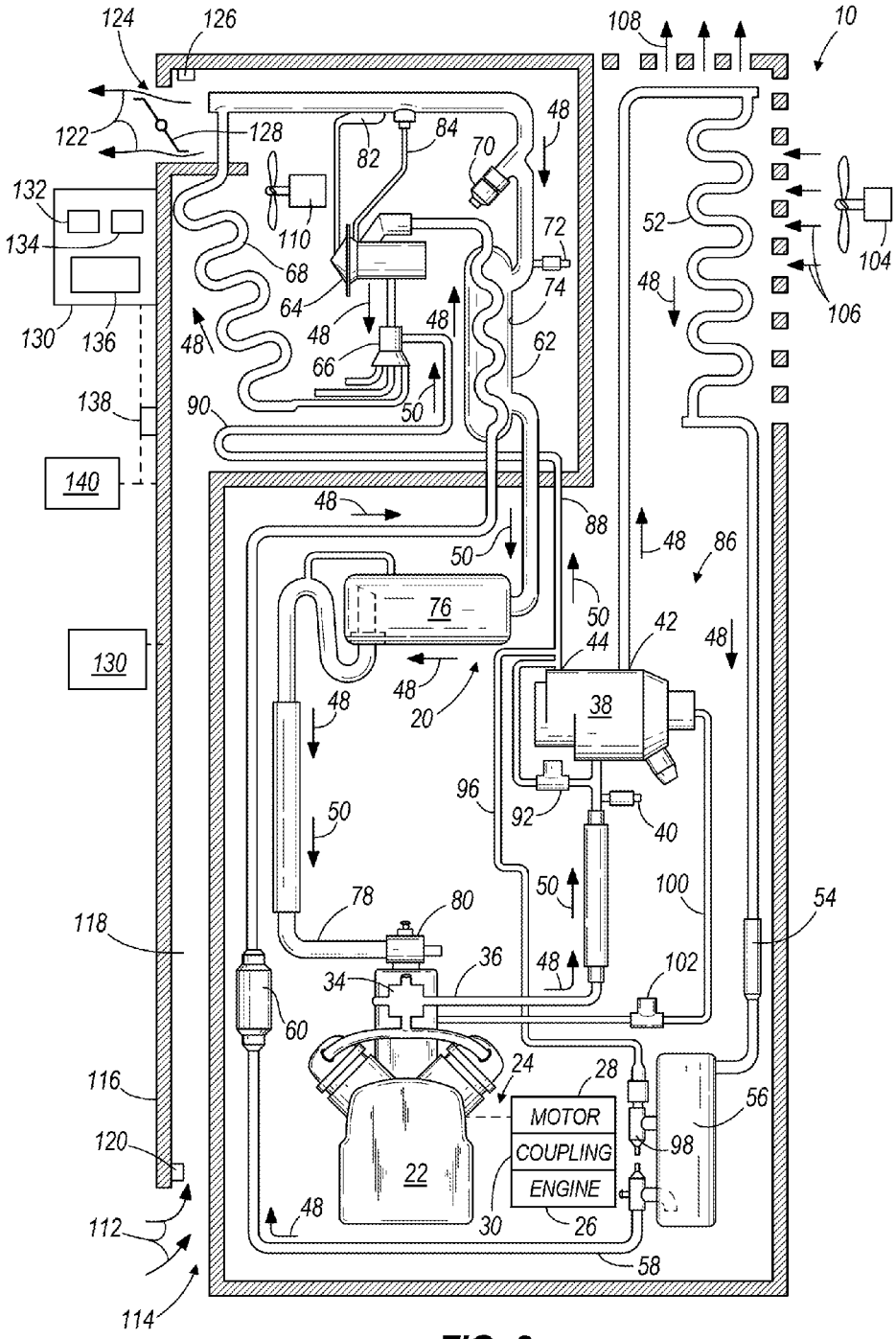
FIG. 2 is a schematic representation of the transport refrigeration unit of FIG. 1.

The TRU 10 controls or regulates the temperature of the cargo space 16 to a specified temperature range adjacent to a predetermined set point temperature ("SP"). More particularly, the TRU 10 maintains the temperature of the cargo space 16 within a range surrounding the set point temperature SP (e.g., SP±5° F.). As shown in FIG. 2, the TRU 10 has a closed refrigerant circuit or flow path 20, which includes a refrigerant compressor 22 driven by a prime mover arrangement 24. The prime mover arrangement 24 includes an internal-combustion engine 26 and an electric motor 28. In one embodiment, the internal-combustion engine 26 is a diesel engine. The TRU 10 further includes a clutch or coupling 30. The coupling 30 is configured to selectively drive the compressor 22 with either the engine 26 or the motor 28. Accordingly, as will be discussed in more detail below, the refrigerant compressor 22 can be driven by engine 26 when the coupling 30 is in a first configuration and the compressor 22 can be driven by the electric motor 28 and disengaged from the engine 26 when the coupling 30 is in a second configuration.

With continued reference to FIG. 2, the TRU 10 further includes a discharge valve 34 and a discharge line 36 that connects the compressor 22 to a three-way valve 38. A discharge pressure transducer 40 is located along the discharge line 36, upstream from the three-way valve 38 to measure the discharge pressure of the compressed refrigerant. The three-way valve 38 includes a first outlet port 42 and a second outlet port 44. When the TRU 10 is operated in a COOLING mode, the three-way valve 38 is adjusted to direct refrigerant from the compressor 22 through the first outlet port 42 and along a first circuit or flow path (represented by arrows 48). When the TRU 10 is operated in HEATING and DEFROST modes, the three-way valve 28 is adjusted to direct refrigerant through the second outlet port 44 and along a second circuit or flow path (represented by arrows 50).

The first flow path 48 extends from the compressor 22 through the first outlet port 42 of the three-way valve 38, a condenser coil 52, a one-way condenser check valve 54, a receiver 56, a liquid line 58, a refrigerant drier 60, a heat exchanger 62, an expansion valve 64, a refrigerant distributor 66, an evaporator coil 68, an electronic throttling valve 70, a suction pressure transducer 72, a second path 74 through the heat exchanger 62, an accumulator 76, a suction line 78, and back to the compressor 22 through a suction port 80. The expansion valve 64 is controlled by a thermal bulb 82 and an equalizer line 84.

The second flow path 50 bypasses a section of the refrigeration circuit 86, including the condenser coil 52 and the expansion valve 64, and connects the hot gas output of compressor 22 to the refrigerant distributor 66 via a hot gas line 88 and a defrost pan heater 90. The second flow path 50 continues from the refrigerant distributor 66 through the evaporator coil 68, the throttling valve 70, the suction pressure transducer 72, the second path 74 through the heat exchanger 62, and the accumulator 76 and back to the compressor 22 via the suction line 78 and the suction port 80.

A hot gas bypass solenoid valve 92 is disposed to inject hot gas into the hot gas line 88 during operation in the COOLING mode. A bypass or pressurizing line 96 connects the hot gas line 88 to the receiver 56 via check valves 98 to force refrigerant from the receiver 56 into the second flow path 50 during operation in the HEATING and DEFROST modes.

Line 100 connects the three-way valve 38 to the low-pressure side of the compressor 22 via a normally closed pilot solenoid valve 102. When the solenoid valve 102 is closed, the three-way valve 38 is biased (e.g., spring biased) to select the first outlet port 42 of the three-way valve 38. When the evaporator coil 52 requires defrosting and when heating is required, valve 92 is energized and the low pressure side of the compressor 22 operates the three-way valve 38 to select the second outlet port 44 to begin operation in the HEATING mode or DEFROST modes.

A condenser fan or blower 104 directs ambient air (represented by arrows 106) across the condenser coil 52. Return air (represented by arrows 108) heated by contact with the condenser fan 104 is discharged to the atmosphere. An evaporator fan 110 draws cargo space air (represented by arrows 112) through an inlet 114 in a bulkhead or wall 116 and upwardly through conduit 118. A return air temperature sensor 120 measures the temperature ($T_1$) of air entering the inlet 114. In the illustrated embodiment, the fans 104, 110 are directly driven by the same power source that drives the compressor 22.

Discharge air (represented by arrow 122) is returned to the cargo space 16 via outlet 124. Discharge air temperature sensor 126 is positioned adjacent to the outlet 124 and measures the discharge air temperature. During the DEFROST mode or during operation in a RECOVERY cycle, a damper 128 is moved from an opened position (shown in FIG. 2) toward a closed position (not shown) to close the discharge air path to the cargo space 16.

The TRU 10 also includes a controller 130. The controller 130 includes a microprocessor 132, a database 134, and a user interface 136. The user interface 136 allows the user to enter load parameters, including the set point temperature ("SP") and an acceptable range surrounding the set point temperature (e.g., SP±5° F.). These values are then saved to the database 134. Also, the database can store preprogrammed set point temperatures and the acceptable range surrounding the set point temperature for various types of cargo. Then, the user can enter the type of cargo (e.g., apples, bananas, flowers, etc.) into the controller 130 via the user interface 136 and the controller 130 automatically recalls the corresponding load parameters, including the set point temperature and acceptable range surrounding the set point temperature from the database 134.

The controller 130 receives data from sensors, including the return air temperature sensor 120 and the discharge air temperature sensor 126. Additionally, given temperature data and programmed parameters, the controller 130 determines whether cooling, heating, or defrosting is required by comparing the data collected by the sensors with the set point temperature SP. Also, the TRU 10 includes a sensor 138, which can be a voltage sensor, a current sensor, or the like. The sensor 138 senses whether an external alternating current electrical power source 140 is available to power the TRU 10. The sensor 138 is in communication with the controller 130 so that the controller 130 can receive a signal from the sensor 130 to indicate whether the electrical source 140 is available to power the TRU 10. The electrical source 140 can include any suitable external alternating current electrical power source. For example, the trailer 14 may parked at a loading dock and the user can plug an electrical cord of the TRU 10 into an electrical outlet near the loading dock to supply external power independent of the TRU 10 to the TRU 10.

Figure 3:
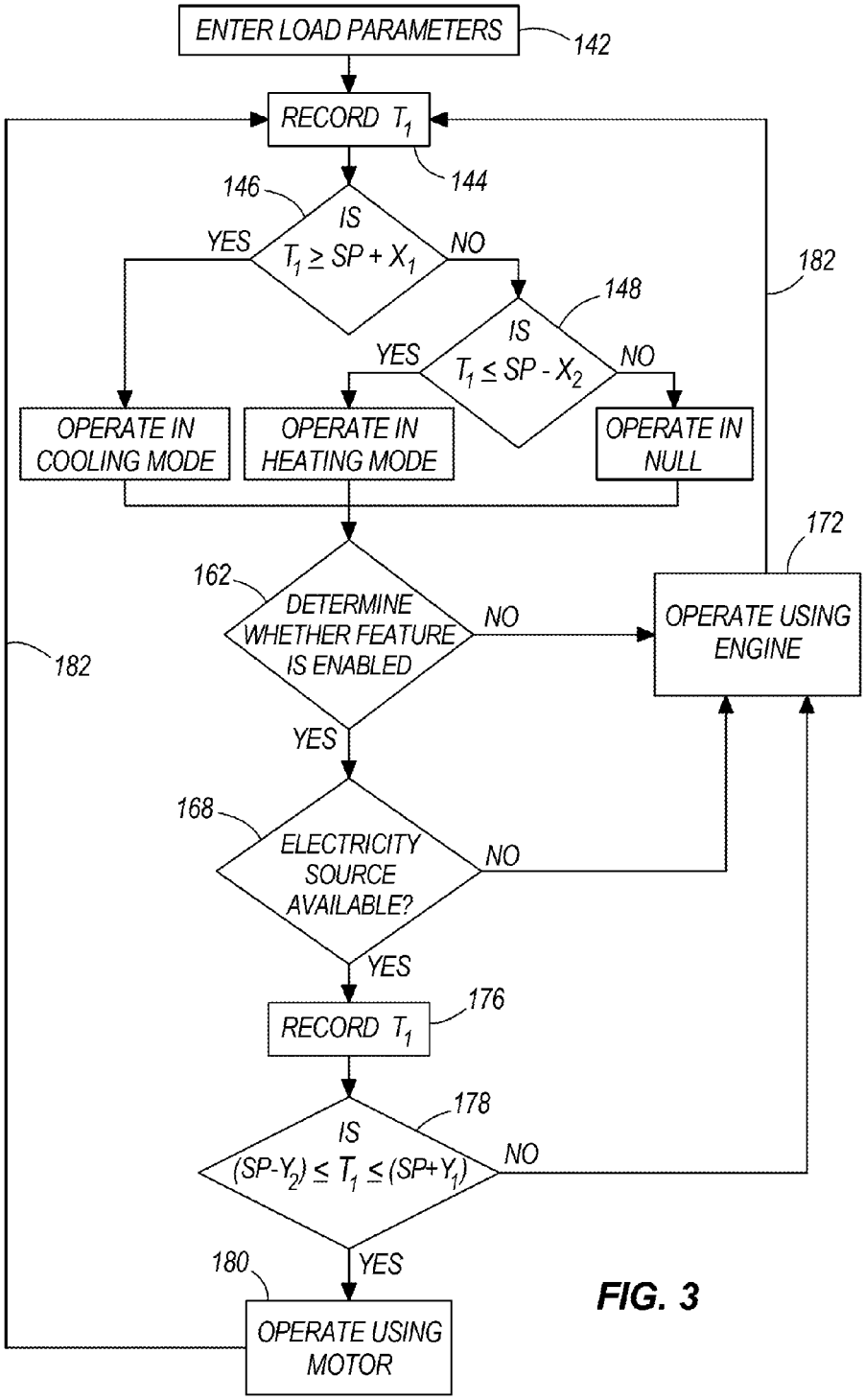
FIG. 3 is a flowchart illustrating a method of operating the transport refrigeration unit of FIG. 1.

Referring to FIGS. 2 and 3, in operation, the controller 130 prompts the operator to enter load parameters, represented by act 142 in FIG. 3. In one embodiment, the controller 130 prompts the operator to enter the set point temperature SP (e.g., 32° F.), a first high temperature limit $X_1$(e.g., °5 F), a first low temperature limit $X_2$ (e.g., °5 F), a second high temperature limit $Y_1$, and a second low temperature limit $Y_2$. In some methods of operation and embodiments, the first and the second high temperature limits $X_1$ and $Y_1$ are equal and the first and the second low temperature limits $X_2$ and $Y_2$ are equal. The purpose of these temperature limits will be discussed in more detail below. The user enters these values into the controller using the interface 136. In other constructions, the controller 130 prompts the operator to enter via the interface 136 the type of cargo (e.g., lettuce, bananas, flowers, ice cream, milk, etc.) and the anticipated travel time (e.g., one hour, two hours, etc.). In these constructions, the controller 130 recalls previously programmed load parameters, including set point temperature SP, first high temperature limit $X_1$, first low temperature limit $X_2$, second high temperature limit $Y_1$, and second low temperature limit $Y_2$ values for the selected cargo type from the database 134 of the controller 130 and the load parameters are automatically entered.

With continued reference to FIGS. 2 and 3, during operation of the TRU 10, the controller 130 determines the return air temperature $T_1$ using the sensor 120 located in the return air conduit 118, which is represented by act 144 in FIG. 3. If the return air temperature $T_1$ is greater than or equal to the sum of the set point temperature SP and the first high temperature limit $X_1$("YES" at act 146) the controller 130 operates the TRU 10 in the COOLING mode to provide relatively cool air to the cargo space 16. During operation in the COOLING mode, the compressor 22 is driven to compress the refrigerant and the refrigerant is directed along the first flow path 48. Additionally, the damper 128 is moved toward the opened position and the evaporator fan 110 is activated to draw cargo space air across the evaporator coil 68. Relatively cold refrigerant flows through the evaporator coil 68 during operation in the COOLING mode and the cargo space air is cooled by contact with the relatively cold evaporator coil 68 before being returned to the cargo space 16 via the outlet 124.

If the return air temperature $T_1$ is less then the sum of the set point temperature SP and the first high temperature limit $X_1$("NO" at act 146) and if the return air temperature $T_1$ is less than or equal to the set point temperature SP minus the first low temperature limit $X_2$ ("YES" at act 148) (i.e., if the return air temperature $T_1$ is below the predetermined acceptable temperature for the load), the controller 130 initiates the HEATING mode to provide relatively warm air to the cargo space 16. During operation in the HEATING mode, the compressor 22 compresses the refrigerant and the refrigerant is directed along the second flow path 50, bypassing portions of the refrigeration circuit 20, including the condenser coil 52, the check valve 54, and the receiver 56.

In act 148, if the return air temperature $T_1$ is greater than the set point temperature SP minus the first low temperature limit $X_2$ ("NO" at act 148, which is also less than then set point temperature SP plus the first high temperature limit $X_1$ because of act 146), the controller 130 operates the TRU 10 in a NULL mode. In the NULL mode, the controller 130 shuts down the compressor 22 or operates the compressor 22 at reduced speed and reduced capacity. Additionally, the controller 130 shuts down or reduces the operating speed of the condenser fans 104 and the evaporator fans 110.

Referring to FIGS. 2 and 3, the compressor 22 can be driven to compress refrigerant for use in the HEATING, the COOLING, and the NULL modes using either the engine 26 or the electrical motor 28. As discussed above, the coupling 30 can be configured by the controller 130 to transfer power from either the engine 26 or the motor 28 to the compressor 22 to drive the compressor 22. As will be discussed below, the controller 130 can automatically switch between using the engine 26 to drive the compressor 22 and the motor 28 to drive the compressor 22.

When the user enters the cargo load parameters, the user can also enable a feature that allows the compressor 22 to automatically switch between being driven by the electrical motor 28 and the engine 26. In act 162 of the flowchart illustrated in FIG. 3, the controller 130 determines whether this feature has been enabled by the user. If the feature has not been enabled ("NO" at act 162), the controller 130 continues to operate the TRU 10 using either the motor 28 or the engine 26 depending on whether the motor 28 or the engine 26 was manually selected by the user to drive the compressor 22 in the HEATING, the COOLING, and the NULL modes described above. If the feature has been enabled by the user ("YES" at act 162), the controller 130 proceeds to act 168 and determines whether the external electrical power source 140 is available.

In act 168, the sensor 138 senses a current, a voltage, or the like and the controller 130 receives a signal from the sensor 138 and determines whether the electrical power source 140 is available. If the controller 130 determines that the electrical power source 140 is not available ("NO" at act 168), the controller operates the TRU 10 using the engine 26 to drive the compressor 22 in the HEATING, the COOLING, and the NULL modes, which is generally indicated by act 172. In order to drive the compressor 22 using the engine 26, the controller 130 automatically starts the engine if the engine 26 is not already operating or running. Also, the controller 130 sends a signal to the coupling 30 to configure the coupling 30, if not already so configured, so that the coupling 30 transfers power from the engine 26 to the compressor 22 in order to drive the compressor 22 to compress the refrigerant.

If the controller 130 determines that the electrical power source 140 is available ("YES" at act 168), the controller 130 determines the temperature within the cargo space 16, which is represented by act 176. In act 176, the return air temperature sensor 120 records the temperature $T_1$ of air entering the TRU 10 through inlet 114 of the return air conduit 118 and transmits the return air temperature data $T_1$ to the controller 130. In general, the return air temperature $T_1$ is substantially equal to the average temperature of the load space air.

After recording the return air temperature $T_1$, the controller 130 determines whether the return air temperature $T_1$ is less than or equal to an upper limit temperature $T_2$ and greater than or equal to a lower limit temperature $T_3$ (act 178). The upper limit temperature $T_2$ is a first predetermined temperature equal to the set point temperature SP plus the second high temperature limit $Y_1$ and the lower limit temperature $T_3$ is a second predetermined temperature equal to the set point temperature SP minus the second low temperature limit $Y_2$. As referenced earlier, the set point temperature SP minus the first low temperature limit $X_2$ defines a third predetermined temperature, and the set point temperature SP plus the first high temperature limit $X_1$ defines a fourth predetermined temperature. If the return air temperature $T_1$ is greater than the upper limit temperature $T_2$ or less than the lower limit temperature $T_3$ ("NO" at act 178) the controller 130 automatically operates the TRU 10 so that the engine 26 drives the refrigerant compressor 22 (represented by act 172) and the motor 28 is turned off. If the return air temperature $T_1$ is less than or equal to the upper limit temperature $T_2$ and greater than or equal to the lower limit temperature $T_3$ ("YES" at act 178), then the controller 130 automatically operates the TRU so that the electric motor 28 drives the refrigerant compressor 22 (represented by act 180) and the engine 26 is turned off.

As indicated by loops 182, the controller 130 continues to monitor whether the electrical power source 140 is available (act 168), whether the TRU should operate in the HEATING, the COOLING, or the NULL mode, and whether the return air temperature $T_1$ is less than or equal to the upper limit temperature $T_2$ and greater than or equal to the lower limit temperature $T_3$ (act 178). As long as the conditions of acts 168 and 178 are met, the controller 130 continues to operate the TRU 10 using the motor 28 to drive the compressor 22. However, if the electric power source 140 is no longer available or if the return air temperature $T_1$ is greater than the upper limit temperature $T_2$ or less than the lower limit temperature $T_3$, the controller 130 automatically switches from driving the compressor 22 with the motor 28 to driving the compressor 22 with the engine 22. The controller 130 automatically switches between these driving arrangements by sending a signal to the coupling in order to configure the coupling so that power is transferred from either the motor 28 or the engine 26 to the compressor 22. Also, if the controller 130 switches from driving the compressor 22 with the motor 28 to driving the compressor 22 with the engine 26, the controller 130 can automatically restart the engine 26 if the engine 26 was shutdown or stopped by the controller 130 or user when the compressor 22 was being driven by the motor 28.

Accordingly, the controller 130 can automatically switch between driving the compressor 22 with the motor 28 and the engine 26. In some applications of the TRU 10 and trailer 14, the user will park the trailer 14 at a loading dock. Then, the user can plug the TRU 10 into the electrical power source 140 (e.g., electrical socket). The controller 130 determines whether the user has plugged the TRU 10 into the power source 140 and the controller 130 also determines the temperature within cargo space 16 of the trailer 14. If the temperature within the cargo space 16 (e.g., $T_1$) is excessively high (e.g., above the upper limit temperature $T_2$), the controller 130 automatically uses the engine 26 to drive the compressor 22 in the COOLING mode. Typically, the engine 26 provides more power than the motor 28, and therefore, the TRU 10 can reduce the temperature within the cargo space 16 (i.e., pull down) quicker by using the engine 26 to drive the compressor 22 than by using the motor 28 to drive the compressor 22. Similarly, if the temperature within the cargo space 16 is excessively low (e.g., below the lower temperature limit $T_3$), the controller 130 automatically uses the engine 26 to drive the compressor 22 in the HEATING mode. Typically, the TRU 10 can increase the temperature within the cargo space 16 quicker by using the engine 26 to drive the compressor 22 than by using the motor 28 to drive the compressor 22 because the engine 26 often provides more power than the motor 28.

Once or if the temperature within the cargo space 16 (e.g., $T_1$) is within a predetermined temperature range (e.g., less than or equal to $T_2$ and greater than or equal to $T_3$), the controller 130 automatically uses the motor 28 to drive the compressor 22 in one or more of the HEATING, the COOLING, and the NULL modes. Therefore, the controller 130 automatically uses the motor 28 when generally less power is required. Using the motor 28 instead of the engine 26 to drive the compressor 22 saves fuel stored on-board the trailer 14 for the engine 26 and can also reduce the amount of noise generated by the TRU 10.

In the illustrated embodiment, the controller 130 automatically switches between driving the compressor 22 with the motor 28 and the engine 26 based on the temperature within the cargo space 16. In other embodiments, the controller 130 can also include a timer that determines the time that has elapsed since start-up of the TRU 10. In such an embodiment, the controller 130 can automatically switch from driving the compressor 22 with the engine 26 to driving the compressor 22 with the motor 28 after a predetermined elapsed time from start-up of the TRU 10. Therefore, the engine 26, which typically provides more power than the motor 28, is used to drive the compressor 22 immediately after start-up of the TRU 10 to quickly pull-down the temperature $T_1$ within the cargo space 16. Then, after the predetermined time has elapsed, the controller 130 automatically switches to driving the compressor 22 with the motor 28 when generally less power is required because the temperature $T_1$ within the cargo space 16 has been pulled down to an acceptable temperature using the engine 26.

Various features and advantages of the invention are set forth in the following claims.

What is claimed is:

1. A method of operating a transport refrigeration unit that is operable to regulate a temperature of a cargo space, the method comprising:

providing a controller;

driving a refrigerant compressor of the transport refrigeration unit with an internal combustion engine to compress a refrigerant defining an engine operating state of the transport refrigeration unit;

driving the refrigerant compressor of the transport refrigeration unit with an electric motor to compress the refrigerant defining a motor operating state of the transport refrigeration unit;

sensing the temperature of the cargo space;

receiving into the controller a signal indicative of the temperature of the cargo space;

determining the temperature of the cargo space using the controller; and switching from the engine operating state to the motor operating state in response to a signal generated by the controller when the controller determines that the temperature of the cargo space is less than or equal to a first predetermined temperature and greater than or equal to a second predetermined temperature less than the first predetermined temperature.

2. The method of claim 1, further comprising shutting down the internal combustion engine in response to a signal generated by the controller after switching from the engine operating state to the motor operating state.

3. The method of claim 1, further comprising, driving the refrigerant compressor with the internal combustion engine to heat the cargo space in response to a signal generated by the controller when the controller determines that the temperature of the cargo space is less than or equal to the second predetermined temperature; and driving the refrigerant compressor with the internal combustion engine to cool the cargo space in response to a signal generated by the controller when the controller determines that the temperature of the cargo space is greater than or equal to the first predetermined temperature.

4. The method of claim 3, further comprising, driving the refrigerant compressor with the electric motor to heat the cargo space in response to a signal generated by the controller when the controller determines that the temperature of the cargo space is less than or equal to a third predetermined temperature and greater than or equal to the second predetermined temperature; and driving the refrigerant compressor with the electric motor to cool the cargo space in response to a signal generated by the controller when the controller determines that the temperature of the cargo space is greater than or equal to a fourth predetermined temperature and less than or equal to the first predetermined temperature.

5. The method of claim 1, wherein switching between the engine operating state and the motor operating state includes switching from the motor operating state to the engine operating state in response to a signal generated by the controller when the controller determines that the temperature of the cargo space is greater than or equal to a predetermined temperature.

6. The method of claim 5, wherein switching from the motor operating state to the engine operating state includes starting the internal combustion engine in response to a signal generated by the controller.

7. The method of claim 1, further comprising providing a coupling to selectively drive the refrigerant compressor in at least one of the motor operating state and the engine operating state.

8. The method of claim 1, further comprising manually entering the predetermined temperature into the controller.

9. A method of operating a transport refrigeration unit that is operable to regulate a temperature of a cargo space, the method comprising:

providing a controller;

driving a refrigerant compressor of the transport refrigeration unit with an internal combustion engine to compress a refrigerant defining an engine operating state of the transport refrigeration unit;

driving the refrigerant compressor of the transport refrigeration unit with an electric motor to compress the refrigerant defining a motor operating state of the transport refrigeration unit;

sensing the temperature of the cargo space;

receiving into the controller a signal indicative of the temperature of the cargo space;

determining the temperature of the cargo space using the controller;

switching between the engine operating state and the motor operating state in response to a signal generated by the controller based on the temperature of the cargo space;

sensing whether an external electrical power source independent of the transport refrigeration unit is available to power the electric motor of the transport refrigeration unit;

receiving into the controller a signal indicative of whether the external electrical power source is available to power the electric motor;

determining whether the external electrical power source is available using the controller; and switching from the motor operating state to the engine operating state in response to a signal generated by the controller when the controller determines that the external electrical power source is not available.

10. A transport refrigeration unit that is operable to regulate a temperature of a cargo space, the transport refrigeration unit comprising:

a sensor configured to sense the temperature of the cargo space;

a controller configured to receive a signal from the sensor indicative of the temperature and the controller configured to determine the temperature;

a refrigerant compressor operable to compress a refrigerant;

an internal combustion engine configured to drive the refrigerant compressor to compress the refrigerant defining an engine operating state of the transport refrigeration unit;

an electric motor configured to drive the refrigerant compressor to compress the refrigerant defining a motor operating state of the transport refrigeration unit; and a coupling configured to selectively couple at least one of the internal combustion engine and the electric motor to the refrigerant compressor to drive the refrigerant compressor, wherein the controller is configured to switch from the engine operating state to the motor operating state in response to a signal generated by the controller when the controller determines that the temperature of the cargo space is less than or equal to a first predetermined temperature and greater than or equal to a second predetermined temperature less than the first predetermined temperature.

11. The transport refrigeration unit of claim 10, wherein the controller is configured to shutdown the internal combustion engine in response to a signal generated by the controller after the controller switches from the engine operating state to the motor operating state.

12. The transport refrigeration unit of claim 10, wherein the controller is configured to drive the refrigerant compressor with the internal combustion engine to heat the cargo space in response to a signal generated by the controller when the controller determines that the temperature of the cargo space is less than or equal to the second predetermined temperature, and wherein the controller is configured to drive the refrigerant compressor with the internal combustion engine to cool the cargo space in response to a signal generated by the controller when the controller determines that the temperature of the cargo space is greater than or equal to the first predetermined temperature.

13. The transport refrigeration unit of claim 12, wherein the controller is configured to drive the refrigerant compressor with the electric motor to heat the cargo space in response to a signal generated by the controller when the controller determines that the temperature of the cargo space is less than or equal to a third predetermined temperature and greater than or equal to the second predetermined temperature, wherein the controller is configured to drive the refrigerant compressor with the electric motor to cool the cargo space in response to a signal generated by the controller when the controller determines that the temperature of the cargo space is greater than or equal to a fourth predetermined temperature and less than or equal to the first predetermined temperature.

14. The transport refrigeration unit of claim 10, wherein the controller is configured to switch from the motor operating state to the engine operating state in response to a signal generated by the controller when the controller determines that the temperature of the cargo space is greater than or equal to a predetermined temperature.

15. The transport refrigeration unit of claim 14, wherein the controller is configured to start the internal combustion engine in response to a signal generated by the controller when the controller switches from the motor operating state to the engine operating state.

16. A transport refrigeration unit that is operable to regulate a temperature of a cargo space, the transport refrigeration unit comprising:

a sensor configured to sense the temperature of the cargo space;

a controller configured to receive a signal from the sensor indicative of the temperature and the controller configured to determine the temperature;

a refrigerant compressor operable to compress a refrigerant;

an internal combustion engine configured to drive the refrigerant compressor to compress the refrigerant defining an engine operating state of the transport refrigeration unit;

an electric motor configured to drive the refrigerant compressor to compress the refrigerant defining a motor operating state of the transport refrigeration unit;

a coupling configured to selectively couple at least one of the internal combustion engine and the electric motor to the refrigerant compressor to drive the refrigerant compressor, wherein the controller is configured to switch between the engine operating state and the motor operating state in response to a signal generated by the controller based on the temperature of the cargo space; and a second sensor configured to sense whether an external electrical power source independent of the transport refrigeration unit is available to power the electric motor of the transport refrigeration unit, wherein the controller is configured to receive into the controller a signal indicative of whether the external electrical power source is available to power the electric motor and the controller is configured to determine whether the external electrical power source is available, and wherein the controller is configured to switch from the motor operating state to the engine operating state in response to a signal generated by the controller when the controller determines that the external electrical power source is not available.

17. A transport refrigeration unit that is operable to regulate a temperature of a cargo space, the transport refrigeration unit comprising:

a first sensor configured to sense the temperature of the cargo space;

a controller configured to receive a signal from the first sensor indicative of the temperature and the controller configured to determine the temperature;

a refrigerant compressor operable to compress a refrigerant;

an internal combustion engine configured to drive the refrigerant compressor to compress the refrigerant defining an engine operating state of the transport refrigeration unit;

an electric motor configured to drive the refrigerant compressor to compress the refrigerant defining a motor operating state of the transport refrigeration unit;

a coupling configured to selectively couple at least one of the internal combustion engine and the electric motor to the refrigerant compressor to drive the refrigerant compressor;

a second sensor configured to sense whether an external electrical power source independent of the transport refrigeration unit is available to power the electric motor of the transport refrigeration unit, wherein the controller is configured to switch from the engine operating state to the motor operating state to cool the cargo space in response to a signal generated by the controller when the controller determines that the temperature of the cargo space is less than or equal to a first predetermined temperature, wherein the controller is configured to switch from the engine operating state to the motor operating state to heat the cargo space in response to a signal generated by the controller when the controller determines that the temperature of the cargo space is greater than or equal to a second predetermined temperature, wherein the second predetermined temperature is less than the first predetermined temperature, wherein the controller is configured to drive the refrigerant compressor with the electric motor to heat the cargo space in response to a signal generated by the controller when the controller determines that the temperature of the cargo space is less than or equal to a third predetermined temperature and greater than or equal to the second predetermined temperature, wherein the controller is configured to drive the refrigerant compressor with the electric motor to cool the cargo space in response to a signal generated by the controller when the controller determines that the temperature of the cargo space is greater than or equal a fourth predetermined temperature and less than or equal to the first predetermined temperature, wherein the controller is configured to receive into the controller a signal indicative of whether the external electrical power source is available to power the electric motor and the controller is configured to determine whether the external electrical power source is available, and wherein the controller is configured to switch from the motor operating state to the engine operating state in response to a signal generated by the controller when the controller determines that the external electrical power source is not available.

* * * * *